US009564276B2

(12) United States Patent
Yujima et al.

(10) Patent No.: US 9,564,276 B2
(45) Date of Patent: Feb. 7, 2017

(54) CABLE SWITCH

(71) Applicant: FOSTER ELECTRIC CO., LTD., Tokyo (JP)

(72) Inventors: Kenta Yujima, Tokyo (JP); Gao Wei, Tokyo (JP); Yoshikazu Okazaki, Tokyo (JP)

(73) Assignee: FOSTER ELECTRIC CO., LTD., Akishima, Tokyo (JP)

( * ) Notice: Subject to any disclaimer, the term of this patent is extended or adjusted under 35 U.S.C. 154(b) by 37 days.

(21) Appl. No.: 14/629,849

(22) Filed: Feb. 24, 2015

(65) Prior Publication Data

US 2015/0303008 A1 Oct. 22, 2015

(30) Foreign Application Priority Data

Apr. 21, 2014 (JP) ..... 2014-087303

(51) Int. Cl.

| | |
|---|---|
| ***H01H 13/02*** | (2006.01) |
| ***H01H 3/14*** | (2006.01) |
| ***H01H 13/703*** | (2006.01) |
| ***H01H 13/704*** | (2006.01) |

(52) U.S. Cl.

CPC ..... *H01H 3/142* (2013.01); *H01H 13/703* (2013.01); *H01H 13/704* (2013.01); *H01H 2211/006* (2013.01)

(58) Field of Classification Search

CPC ..... H01H 13/02; H01H 3/16; H01H 35/00; H01H 3/14

USPC ..... 200/52 R, 86 R

See application file for complete search history.

(56) References Cited

U.S. PATENT DOCUMENTS 5,554,835 A * 9/1996 Newham ..... G08B 21/22 200/512

* cited by examiner

*Primary Examiner* — Edwin A. Leon
*Assistant Examiner* — Iman Malakooti
(74) *Attorney, Agent, or Firm* — Allen Dyer Doppelt Milbrath & Gilchrist

(57) ABSTRACT

A cable switch comprising a first base member of a band shape provided with a conductor on an inner surface and a second base member facing the first base member, and including a flat positive electrode and a negative electrode, the positive electrode being provided on one side of an inner surface thereof and the negative electrode being provided on another side of the inner surface, a gap being formed between the positive electrode and the negative electrode for separating and insulating the positive electrode and the negative electrode from each other.

4 Claims, 18 Drawing Sheets

CABLE SWITCH

CROSS REFERENCE TO RELATED APPLICATION

This application claims the benefit of Japanese Patent Application No. 2014-087303, filed on Apr. 21, 2014, the contents of which are herein incorporated by reference in their entirety.

FIELD OF THE INVENTION

The present invention relates to a cable switch that is difficult to be turned on when being bent, that can be easily turned on when being pressurized by fingers, and that is suitable for use as a switch attached to earphones.

BACKGROUND OF THE INVENTION

It is common to use earphones or headphones when a listener/user listens to/hears the sound from equipment such as a portable audio player, for example, a CD player or an MD player, or a personal digital assistance. In this case, a cable is generally used to connect the equipment to the earphones.

In this case, a control box for volume adjustment and player operation control (to select music, to turn on or off a player, etc.) is normally provided halfway along the cable, and a switch is provided at the control box. Furthermore, in a case of an earphone main body equipped with a wireless function, a switch is provided at the earphone main body.

In many cases, a listener uses earphones with the portable equipment while he/she is jogging or working on some other things. In these situations, if the position of the switch is limited to one point on the cable in a case of switch operation for the control over the player or the like, the listener has to look for the position to operate the switch. This is slow and the listener may feel the operation cumbersome.

To overcome these disadvantages, there are proposed techniques for allowing the cable itself to include a switch function. With these cables, the location of switch operation is not limited.

[Patent Literature 1] Japanese Patent Application Laid-Open No. 05-301589.

[Patent Literature 2] Japanese Patent No. 3447225.

In a case of a switch according to Japanese Patent Application Laid-Open No. 05-301589, two conductive members are vertically distanced from each other and arranged in an outer skin to face each other, and conductive rubber is provided between the two conductive members. The switch is configured so that, if external pressure is applied to the switch, the two conductive members contact each other and become conductive and the switch is turned on.

In a case of a switch according to U.S. Pat. No. 3,447,225, two conductive members covered with conductive rubber are arranged within an outer skin to be distanced from each other, and the two conductive members contact each other and become conductive if external pressure is applied to the switch.

These conventional techniques have the following problems. Since each of the switches includes the conductive rubber, the resistance of the switch using the conductive rubber decreases and the switch possibly operates in an unintended way when the switch is bent.

Furthermore, if the switch is not pressurized by the hand but is bent, the switch is often easily turned on and tends to malfunction.

SUMMARY OF THE INVENTION

The present invention has been made in light of the aforementioned, and an object of the present invention is to provide a cable switch for which electrical conduction is difficult to be produced or is not produced by deformation when being bent but for which electrical conduction is easily produced by finger pressing.

A cable switch according to the present invention includes: a first base member of a band shape provided with a conductor on an inner surface thereof; and a second base member facing the first base member, and including a flat positive electrode and a negative electrode, the positive electrode being provided on one side of an inner surface thereof and the negative electrode being provided on another side of the inner surface, a gap being formed between the positive electrode and the negative electrode for separating and insulating the positive electrode and the negative electrode from each other, and is characterized in that generally rectangular windows arranged at predetermined intervals are formed in a length direction by means of a spacer provided between the positive electrode and the negative electrode, thereby allowing for electrical conduction between the positive electrode and the negative electrode via the conductor.

According to an aspect of the present invention, the cable switch is characterized in that the positive electrode and the negative electrode are corrugated to alternately face each other, and the gap between the positive electrode and the negative electrode is also corrugated.

According to another aspect of the present invention, the cable switch is characterized in that the positive electrode and the negative electrode are rectangular to alternately face each other, and the gap between the positive electrode and the negative electrode is also rectangular.

According to a further aspect of the present invention, the cable switch is characterized in that the positive electrode and the negative electrode are linear, the gap between the positive electrode and the negative electrode is also linear, and a position of the linear gap is offset from a central portion of a width of the windows.

According to the present invention, malfunction resulting from the conductive rubber does not occur to the switch since the conductive rubber is not used in the switch. Furthermore, according to the present invention, the groove is provided to separate and isolate the positive electrode and the negative electrode provided in the second base material from each other for the conductor of the first base material, and the spacer is provided between the first base material and the second base material. Therefore, the electrical conduction is made difficult to be produced or is not produced by the deformation caused by bending but is easily produced by finger pressing.

DETAILED DESCRIPTION OF THE PREFERRED EMBODIMENTS

Figure 1:
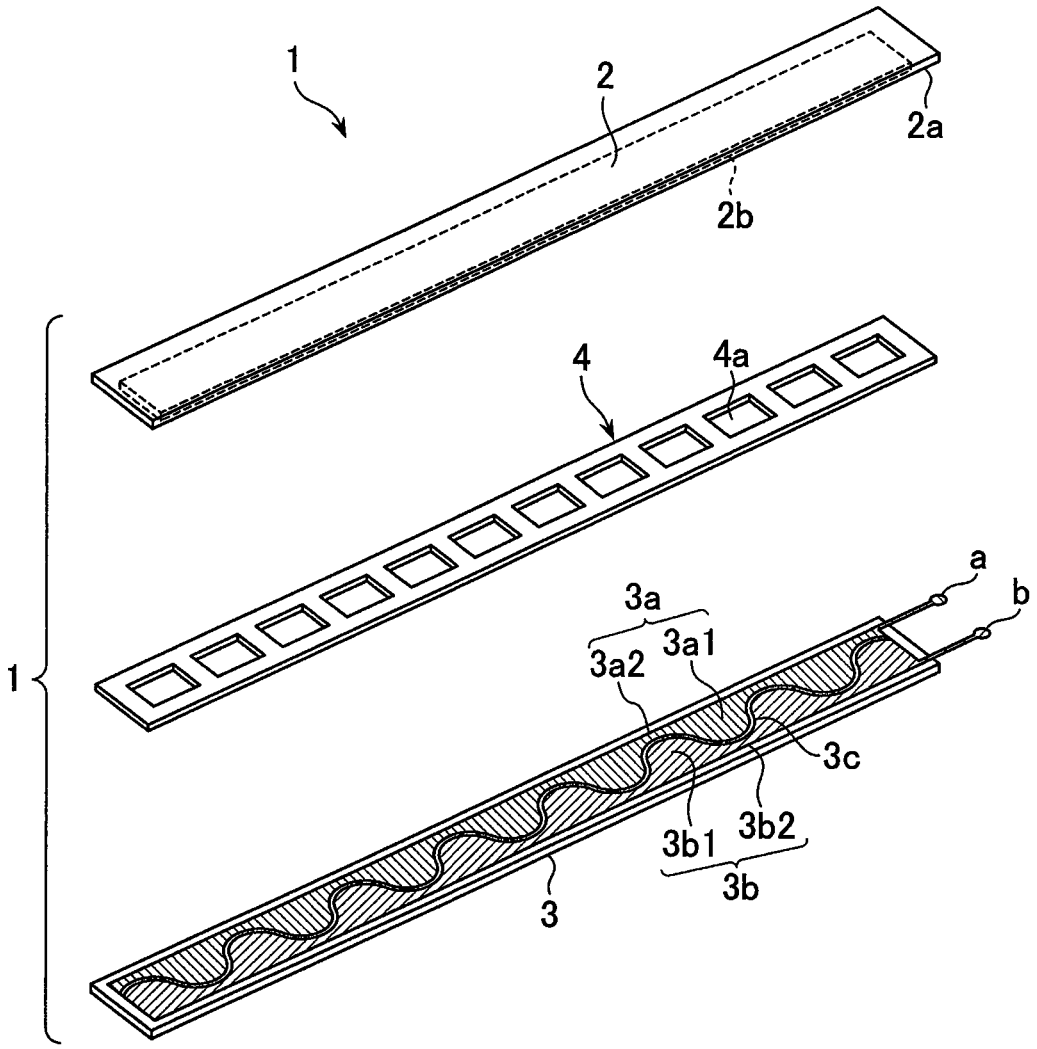
FIG. 1 is an exploded perspective view of main constituent elements according to a first embodiment of the present invention.
Figure 2:
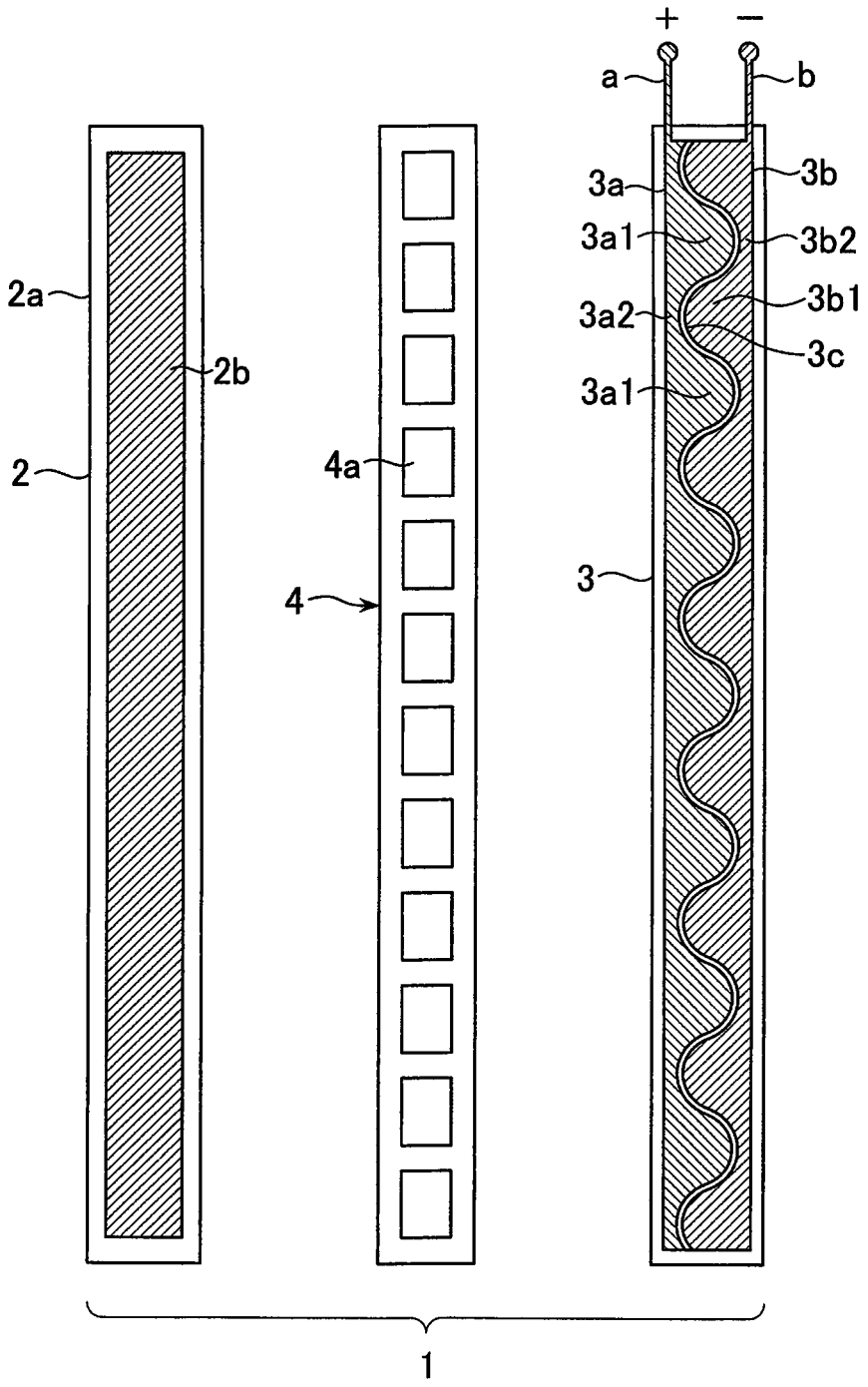
FIG. 2 is a plan view of the main constituent elements shown in FIG. 1.

FIG. 1 is an exploded perspective view of a flat cable switch according to a first embodiment of the present invention. FIG. 2 is a plan view of main constituent elements of the cable switch according to the present invention A cable switch 1 according to the present invention includes a first base material 2 of a an elongated band shape, a second base material 3 of the same shape as that of the first base material 2 and arranged to face the first base material 2 and to be distanced from the first base material 2, and a spacer 4 of a band shape provided to be sandwiched between these first and second base materials 2 and 3.

The first base material 2 is constituted by an insulating material 2*a* made of, for example, a flexible polyester film and a conductor 2*b* provided on an inner surface of the insulating material 2*a* by printing. This conductor 2*b* is formed to be slightly smaller than the insulating material 2*a*. To help understand this, FIG. 2 shows the first base material 2 in a planar state in which the first base material 2 is viewed from an inner surface thereof. As the conductor 2*b*, a blend of silver paste and carbon paste (silver+carbon) is used, for example.

The second base material 3 is made of a polyester film similarly to the insulating material 2*a* of the first base material 2, and a positive electrode 3*a* and a negative electrode 3*b* arranged to face this positive electrode 3*a* and to be distanced from the positive electrode 3*a* are provided in a planar fashion by printing.

The positive electrode 3*a* and the negative electrode 3*b* are formed to face each other in concave and convex ways on a flush inner surface of the second base material 3, and concave portions and convex portions are arranged alternately to face one another on the same plane.

That is, the positive electrode 3*a* is arranged on one side in a width direction of the second base material 3 (left in FIG. 1), the negative electrode 3*b* is arranged on the other side (right in FIG. 1), and shapes of the concave and convex portions are formed to be corrugated in the present embodiment.

A shape of the positive electrode 3*a* located on one edge side of the second base material 3 is linear in a length direction. A side of the positive electrode 3*a* that faces the negative electrode 3*b* is formed into a corrugated shape. The corrugated shape, which is like a sine wave, is constituted by convex portions 3*a*1 protruding toward the negative electrode 3*b* and concave portions 3*a*2 continuous to the convex portions 3*a*1.

That is, in the positive electrode 3*a*, the convex portions 3*a*1 are provided protruding at intervals in the length direction of the positive electrode 3*a*, and the concave portions 3*a*2 are formed between the adjacent convex portions 3*a*1, so that the positive electrode 3*a* is formed into the corrugated shape.

The negative electrode 3*b* is constituted by convex portions 3*b*1 and concave portions 3*b*2 similar to the convex portions 3*a*1 and concave portions 3*a*2 of the positive electrode 3*a*, respectively, and is formed into a corrugated shape.

In the positive electrode 3*a* and the negative electrode 3*b* arranged to face each other, the mutual convex and concave portions are alternately arranged. As shown in FIG. 2, the convex portion 3*b*1 of the negative electrode 3*b* is located in the concave portion 3*a*2 between the adjacent convex portions 3*a*1 of the positive electrode 3*a*, and a corrugated gap 3*c* is formed between the positive electrode 3*a* and the negative electrode 3*b* facing each other.

A positive electrode lead wire A and a negative electrode lead wire B are led from one end portion of the second base material 3.

In FIGS. 1 and 2, reference symbol 4 denotes the spacer and the spacer 4 is provided between the first base material 2 and the second base material 3.

This spacer 4 has a predetermined thickness, generally rectangular windows 4*a* are formed at predetermined intervals along a length direction, and the spacer 4 is formed into a ladder shape.

The spacer 4 is made of an insulating material, for example, resist (insulating ink), polyimide and adhesive, or polyester and adhesive. The spacer 4 is flexural and provided on the positive electrode 3*a* and the negative electrode 3*b*.

Figure 3:
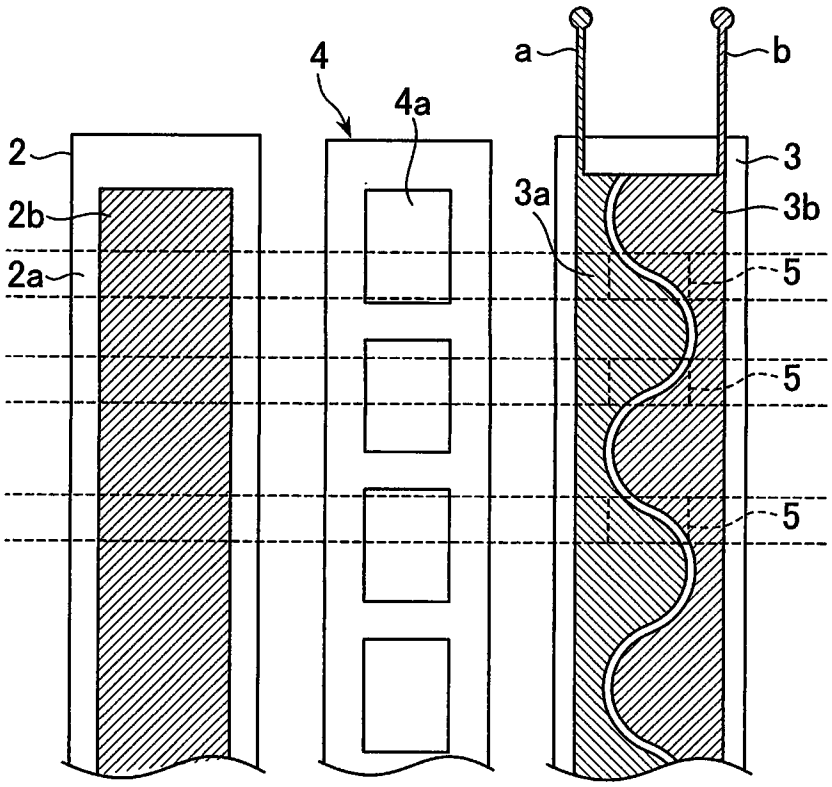
FIG. 3 is a partial enlarged plan view of the main constituent elements shown in FIG. 1.

FIG. 3 is an enlarged view of the first base material 2, the spacer 4 that includes the generally rectangular windows 4*a* arranged at the predetermined intervals in the length direction, and the second base material 3. Areas indicated by dashed rectangles between the positive electrode 3*a* and the negative electrode 3*b* of the second base material 3 are conductive points 5. The conductive points 5 are portions in which electrical conduction is produced between the positive electrode 3*a* and the negative electrode 3*b* via the conductor 2*b* provided on the inner surface of the insulating material of the first base material 2. The conductive points are designed to avoid areas near centers of the windows 4*a*.

Figure 4:
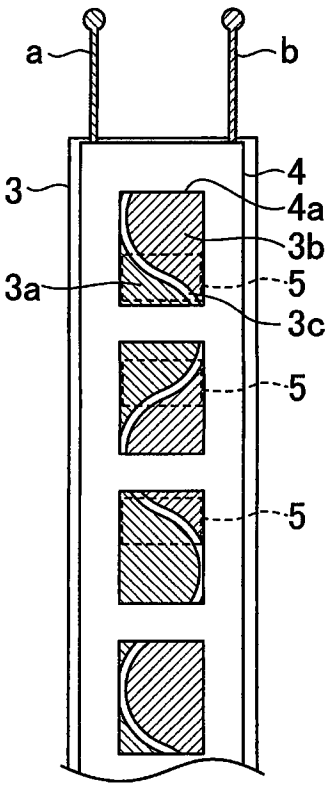
FIG. 4 is a partial enlarged plan view in a partially assembled state according to the first embodiment of the present invention.

FIG. 4 shows a state in which the spacer 4 is provided on the positive electrode 3*a* and the negative electrode 3*b* of the second base material 3 by, for example, printing. The spacer 4 is formed into a shape slightly smaller than an external shape of the second base material 3. The positive electrode 3*a* and the negative electrode 3*b* that are arranged to face each other via the corrugated gap 3*c* are exposed from the windows 4*a* of the spacer 4. The gap 3*c* seen from the windows 4*a* is constituted by outward routes from one side of the windows 4*a* (left in FIG. 4) to the other side (right in FIG. 4) and return routes from the other side (right in FIG. 4) back to one side (left in FIG. 4). These outward and return routes extend along the length direction of the second base material 3 into a corrugated shape. The conductive points 5 are located within the windows 4*a*.

Figure 5:
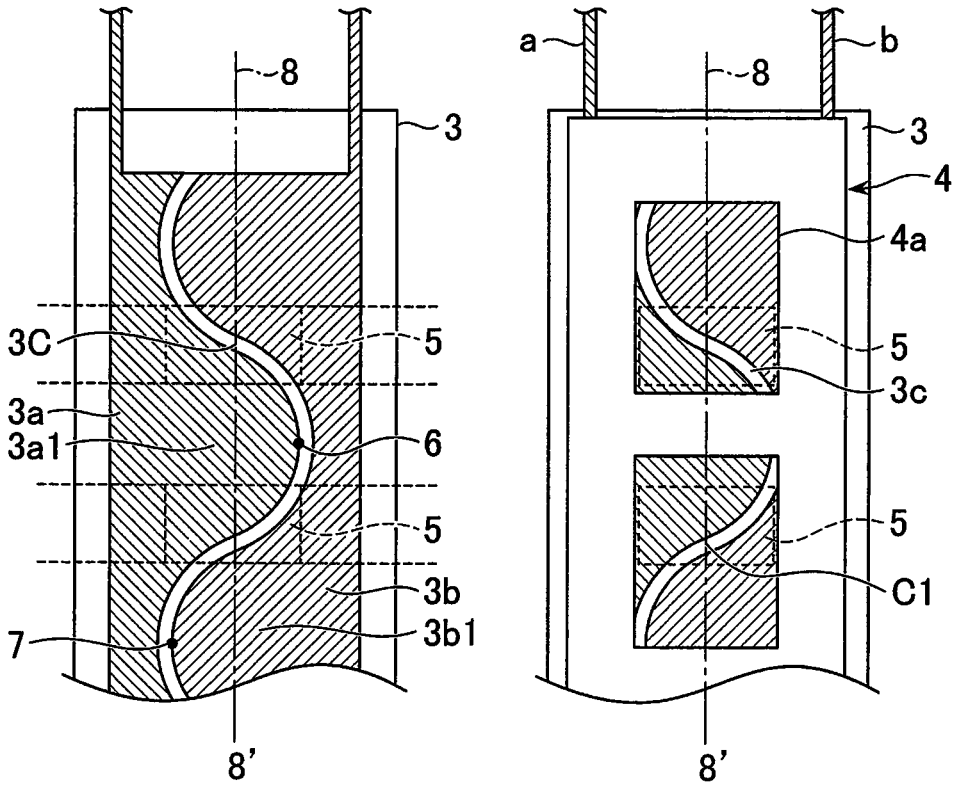
FIG. 5 is a partial enlarged plan view of the main constituent elements according to the first embodiment of the present invention.

As shown in an enlarged view of FIG. 5 in detail, the conductive points 5 are designed so that an amplitude central point 6 of the corrugated shape of the convex portions 3*a*1 of the positive electrode 3*a* and an amplitude central point 7 of the convex portions 3*b*1 of the corrugated shape of the negative electrode 3*b* are not located on a center line 8-8' indicated by a chain line in a width direction of the windows 4*a* of the spacer 4.

That is, in this embodiment, when the cable switch 1 is bent, the regions in which the electrical conduction is produced correspond only to regions in which the gap 3*c* between the positive electrode 3*a* and the negative electrode 3*b* is located at a central position of a width of the each window 4*a*.

Figure 7:
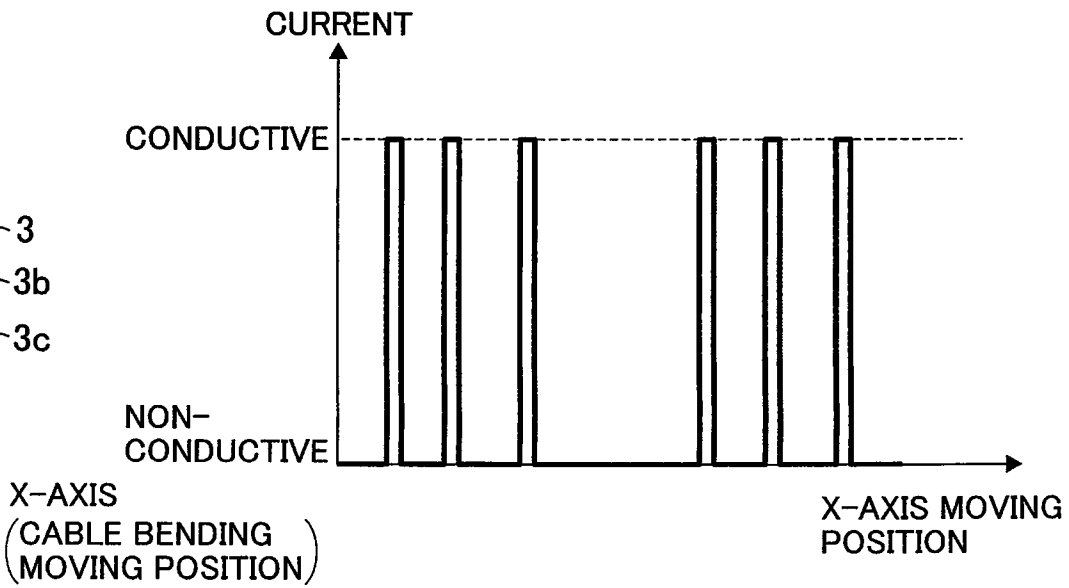
FIG. 7 is an explanatory diagram for operation according to the present invention.
Figure 6:
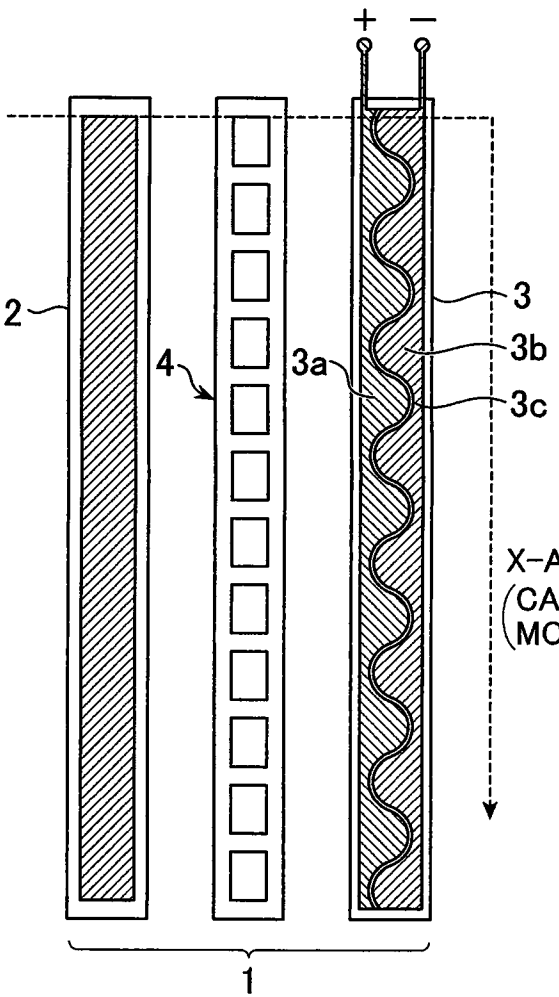
FIG. 6 is an explanatory diagram for operation according to the present invention.

FIG. 6 is an explanatory diagram in a case in which a conductive state and a non-conductive state appear as shown in FIG. 7 if the flat cable switch 1 according to the present invention is constituted by, for example, providing the spacer 4 on the second base material 3, providing the first base material 2 on the spacer 4, and integrating the first base material 2, the second base material 3, and the spacer 4, and the flat cable switch 1 is bent in an X-axis direction.

Figure 8:
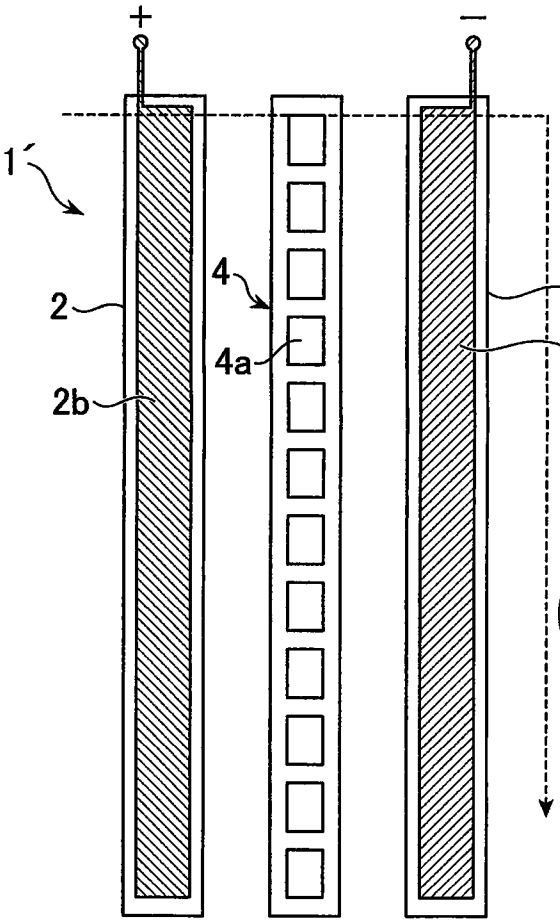
FIG. 8 is an operation explanatory diagram of another cable switch in comparison to the first embodiment of the present invention.

By contrast, as shown in FIG. 8, it is assumed that a cable switch 1' is constituted by the first base material 2 provided with the first conductor 2*b* of the band shape serving as a positive electrode, and the second base material 3 provided with a second conductor 3' of a band shape serving as a negative electrode, and the spacer 4 sandwiched between the first and second base materials 2 and 3 and including the windows 4*a*.

Figure 9:
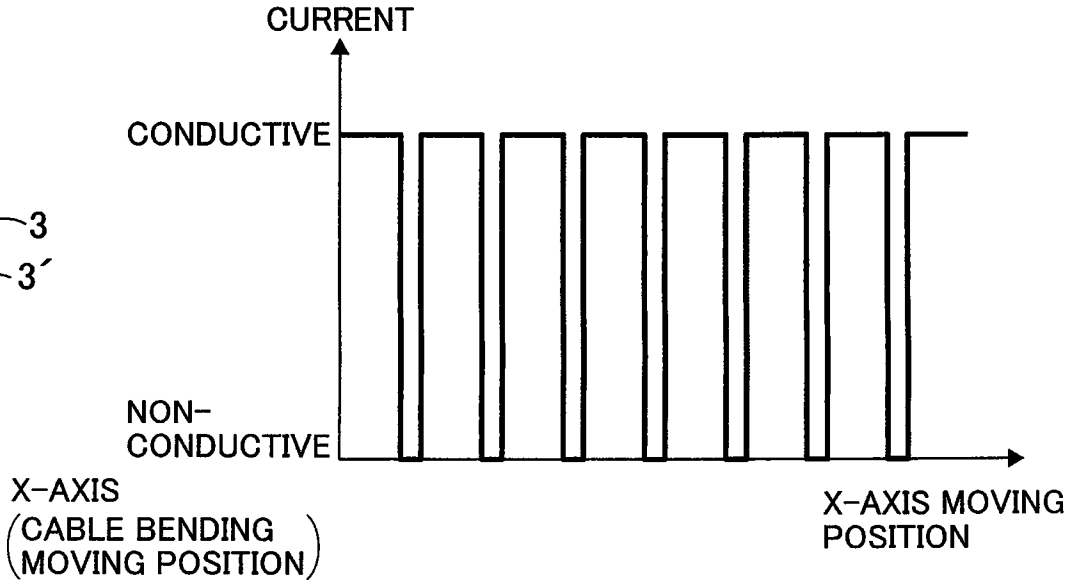
FIG. 9 is an operation explanatory diagram of another cable switch in comparison to the first embodiment of the present invention.

In this case, conductive points correspond to a wide area of entire surfaces of the first conductor 2*b* and the second conductor 3' within the windows 4*a*. Owing to this, if the cable switch 1' is bent, the electrical conduction is disadvantageously and easily produced as shown in FIG. 9.

To prevent such a problem, according to the present invention, the positive electrode 3*a* and the negative electrode 3*b* are formed into concave and convex corrugated shapes that alternately face one another via the gap, and contact portions between the positive electrode 3*a* and the negative electrode 3*b* via the conductor 2*b* are provided to deviate from the central positions within the windows 4*a*. By doing so, the electrical conduction is not easily produced and unintended reaction is prevented from occurring even when the cable switch is bent. As shown in FIG. 7, the portions in which the electrical conduction is produced are present even in this embodiment; however, the appearance of the electrical conduction states to this extent is practically ignorable and does not cause any problems.

As for finger pressing, if portions within one window 4*a* are pressed, the positive electrode 3*a* becomes conductive to the negative electrode 3*b* via the conductor 2*b*.

Figure 10:
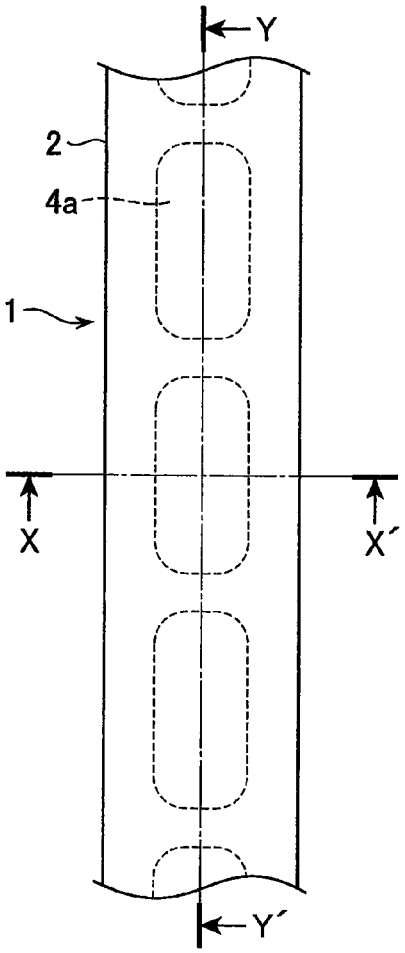
FIG. 10 is a partial schematic plan view according to the first embodiment of the present invention.
Figure 11:
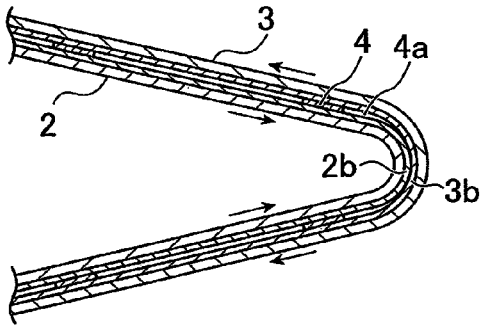
FIG. 11 is a cross-sectional view taken along a line Y-Y' of FIG. 10 during bending.
Figure 12:
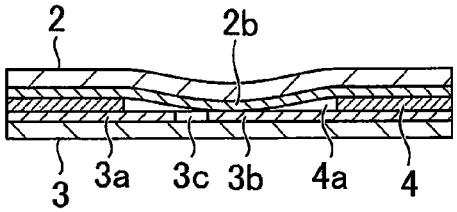
FIG. 12 is a cross-sectional view taken along a line X-X' of FIG. 10 during bending.

FIG. 10 is a schematic plan view of the cable switch 1. FIG. 11 is a cross-section taken along a line Y-Y' of FIG. 10 when the cable switch 1 is bent. FIG. 12 is a cross-section taken along a line X-X' of FIG. 10 when the cable switch 1 is bent.

The bending that occurs to the flat cable switch 1 according to the present invention is mainly that in a thickness direction of the cable switch 1. In this case, deformation occurs on a vertical plane, that is, in a direction in which the first base material 2 contacts the second base material 3. At the time of occurrence of the bending, a force of compressing in a length direction of the cable switch 1 is generated and a deformation of a shape of a side surface of a column is generated on a left inner side surface of the bending shown in FIG. 11 as indicated by arrows. Owing to this, a cross-section between the spacers on both sides of the cable assumes rigidity so as to be kept linear, and movement to an outer side of the bending (right in FIG. 11) is suppressed. Furthermore, a force of extending in the length direction of the cable switch 1 is generated on the second base material 3 on an outer side surface of the bending as indicated by outside arrows. In this case, however, the second base material 3 is deformed not into the shape of the side surface of the column but into a shape closer to a planar shape. As a result, it is most likely that the conductor 2*b* contacts the positive and negative electrodes 3*a* and 3*b* in a portion distant from the spacer 4 (near a center of the window 4*a* of the spacer 4).

When the degree of bending increases and the conductor 2*b* contacts the positive and negative electrodes 3*a* and 3*b*, the inner side surface of the bending (left in FIG. 11) is pressed from the right outer side surface in FIG. 11 in a direction of returning the shape to the shape of the column and the outer side surface of the bending is closer to the shape of the side surface of the column even if the degree of bending further increases. Owing to this, a force for keeping the cross-section between the spacers on both sides of the width of the cable switch 1 to be linear is generated on both the inner and outer side surfaces of the bending, and a force in a direction for keeping an interval corresponding to the thickness of the spacer 4 is generated. As a result, even if the degree of bending increases after the contact on the vertical plane, it is difficult to generate the contact of a large area in the case of the contact by finger pressing. That is, with the deformation caused by bending, the contact is generated only in the central portion in the width direction of the cable switch 1 and the central portions of the windows 4*a* of the spacer 4 in the length direction of the cable switch 1.

To produce the electrical conduction between the positive electrode 3*a* and the negative electrode 3*b* by bending, it is necessary for the electrodes to contact each other via the conductor 2*b*. Therefore, a gap is formed between both electrodes by the spacer 4 in portions other than the bending-induced contact portions so as to make it difficult to produce the electrical conduction due to the deformation by bending even if the electrical conduction is produced due to the finger pressing.

Figure 13:
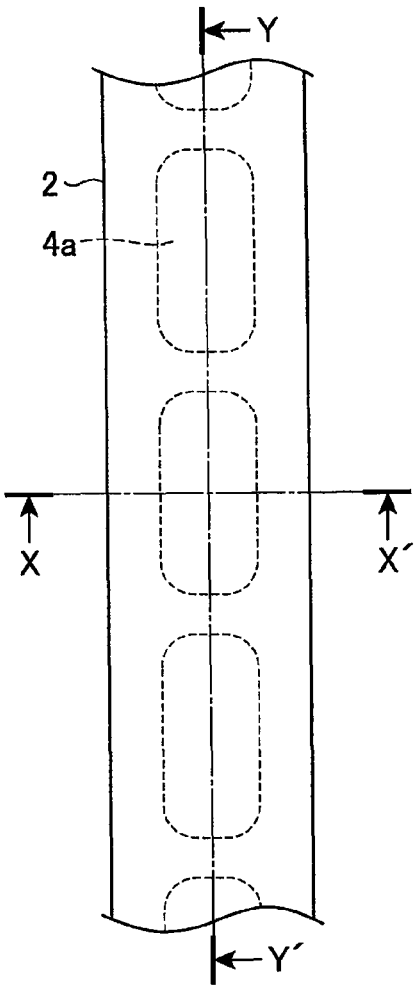
FIG. 13 is a partial schematic plan view according to the first embodiment of the present invention.
Figure 14:
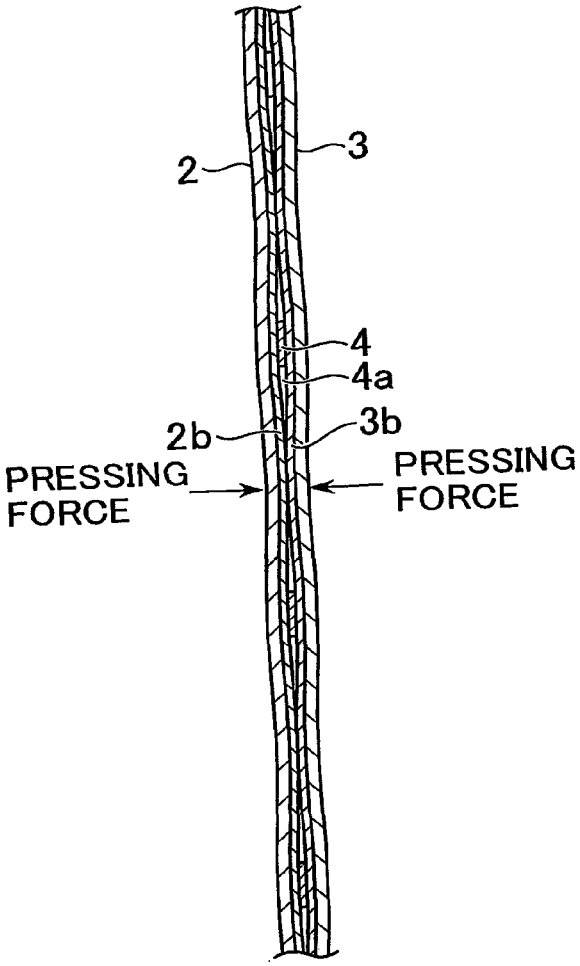
FIG. 14 is a cross-sectional view taken along a line Y-Y' of FIG. 13 during finger pressing.
Figure 15:
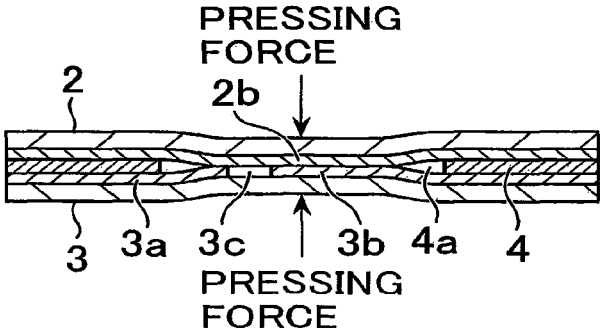
FIG. 15 is a cross-sectional view taken along a line X-X' of FIG. 13 during finger pressing.

FIG. 13 is a schematic plan view of the cable switch 1. FIG. 14 is a cross-sectional view taken along a line Y-Y' of FIG. 13 during finger pressing, and FIG. 15 is a cross-sectional view taken along a line X-X' of FIG. 13.

In a case of the finger pressing, it is possible to contact the positive electrode 3*a* with the negative electrode 3*b* at the pressing part within the window 4*a* and to easily produce the electrical conduction therebetween.

Figure 16A:
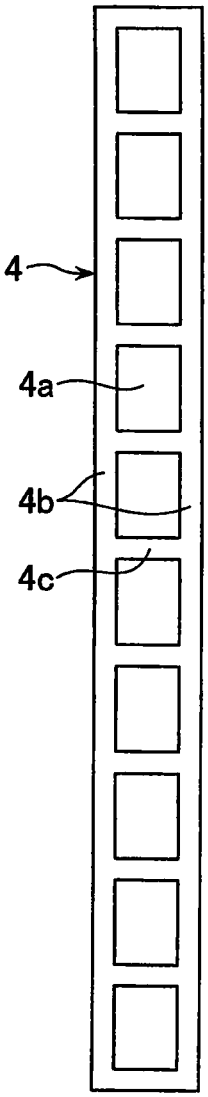
FIG. 16A is a plan view of a spacer used in the first embodiment of the present invention.

In the first embodiment, the spacer 4 has been described while referring to the spacer 4 of a sheet shape in which the rectangular windows 4*a* are formed at the intervals in a slightly wide band member as shown in FIG. 16A. Alternatively, the spacer 4 may be configured as shown in FIG. 16B or 16C.

That is, in FIG. 16A, the spacer 4 is configured as follows. The spacer 4 includes a pair of linear portions 4*b* extending in parallel, distanced from each other, and arranged on both sides, respectively, and joint portions 4*c* bridged between the linear portions 4*b* at predetermined intervals so as to form the windows 4*a* along a length direction of the linear portions 4*b*. In this example, both end portions of the joint portions 4*c* are coupled to and integrated with the linear portions 4*b*.

Figure 16B:
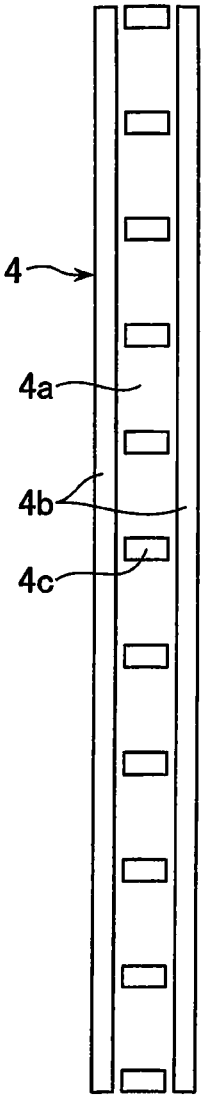
FIG. 16B is a modification of the spacer.

Alternatively, as shown in FIG. 16B, the joint portions 4*c* bridged between the linear portions 4*b* may not be in contact with the linear portions 4*b*.

Figure 16C:
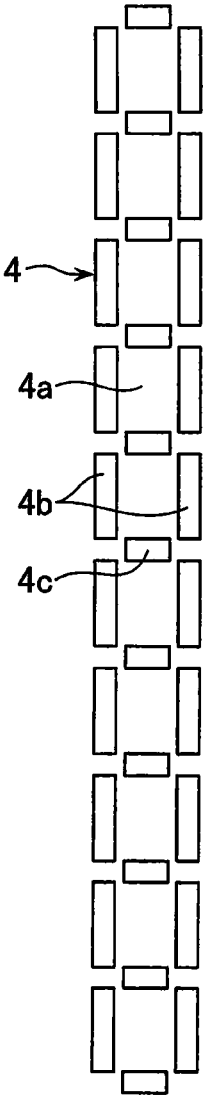
FIG. 16C is a modification of the spacer.

In another alternative, as shown in FIG. 16C, the linear portions 4*b* may be divided at positions of the joint portions 4*c* to form the spacer 4 into segments.

As described above, it suffices that the spacer 4 includes the generally rectangular windows 4*a* arranged at predetermined intervals in the length direction, and is configured as shown in any one of FIGS. 16A to 16C.

While an example in which shapes of the positive electrode 3*a* and the negative electrode 3*b* are the corrugated shapes similar to the shape of the sine wave has been described in the first embodiment, the shapes may be corrugated shapes similar to the shape of a triangular wave.

Figure 17:
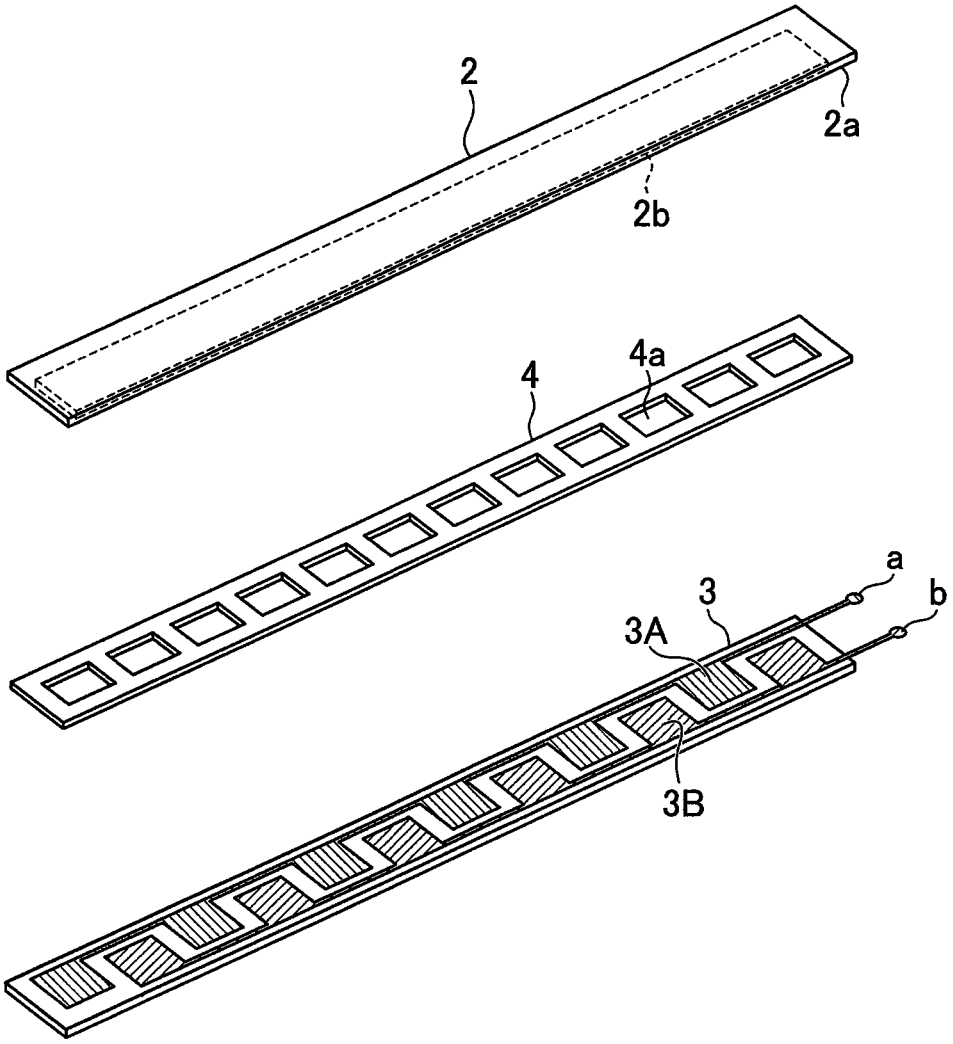
FIG. 17 is an exploded perspective view according to a second embodiment of the present invention.
Figure 18:
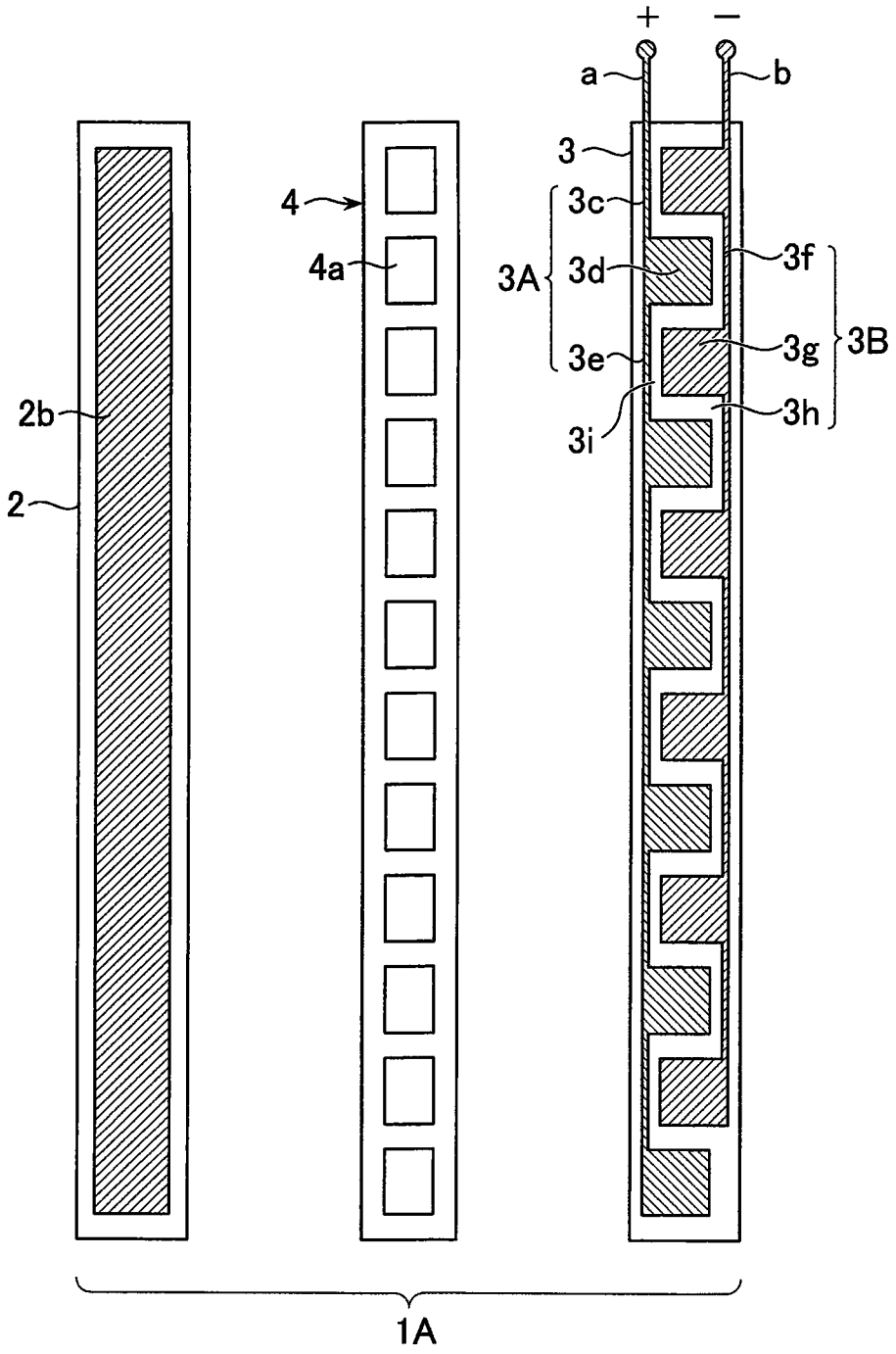
FIG. 18 is a plan view of constituent elements shown in FIG. 17.

FIG. 17 is an exploded perspective view of main constituent elements according to a second embodiment of the present invention. FIG. 18 is a plan view of the respective constituent elements.

In this embodiment, similarly to the first embodiment, the positive electrode 3*a* and the negative electrode 3*b* are formed into convex and concave shapes; however, specific shapes of the concave and convex portions are rectangular shapes.

That is, as shown in FIG. 18 in detail, the positive electrode 3A includes a linear portion 3*c* extending in the length direction along one side of the second base material 3, and convex portions 3*d* provided protruding at predetermined intervals along a length direction of this linear portion 3*c*. Each of these convex portions 3*d* protrudes toward the negative electrode 3B that is arranged to face the positive electrode 3A and is formed into a rectangular shape. Concave portions 3*e* are formed between the adjacent convex portions 3*d* provided protruding along the length direction.

Likewise, the negative electrode 3B includes a linear portion 3*f*, convex portions 3*g*, and concave portions 3*h*. The convex portions 3*g* of the negative electrode 3B are located in the concave portions 3*e* of the positive electrode 3A, respectively. The convex portions 3*d* of the positive electrode 3A are located in the concave portions 3*h* of the negative electrode 3B, respectively. A gap 3*i* of a rectangular corrugated shape is formed between the mutual electrodes facing each other.

Since the other constituent elements according to the second embodiment are the same as those according to the first embodiment, like constituent elements are denoted by like reference symbols.

Figure 19:
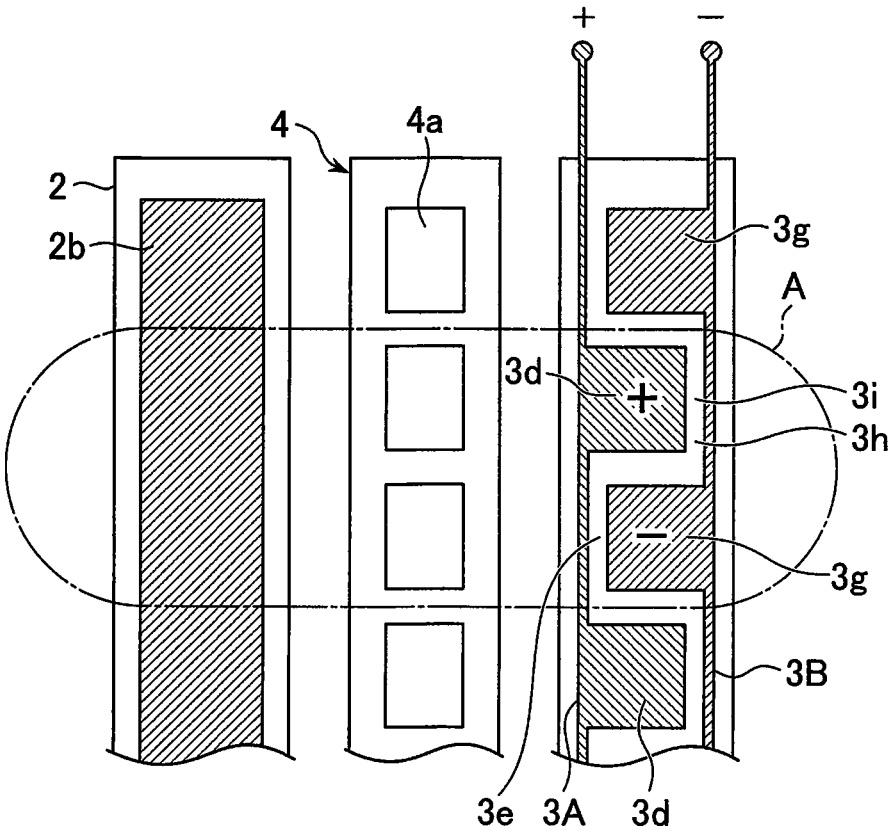
FIG. 19 is a partial enlarged plan view according to the second embodiment of the present invention.

In FIG. 19, a track-shaped part A indicated by a chain line shows a pressurized area.

FIGS. 20 to 25 are explanatory diagrams showing conductive and non-conductive states of a cable switch 1A according to the second embodiment of the present invention.

Figure 20:
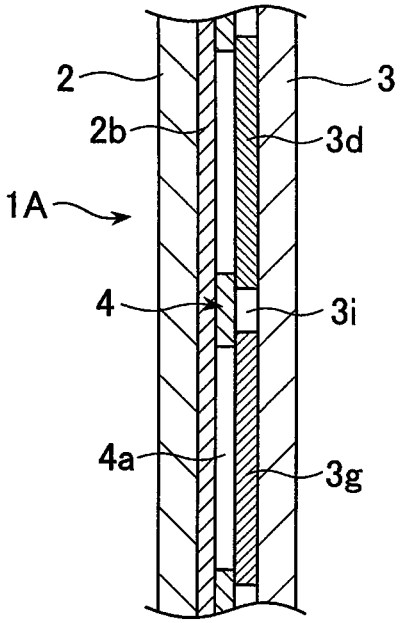
FIG. 20 is a partial cross-sectional view of FIG. 19.
Figure 21:
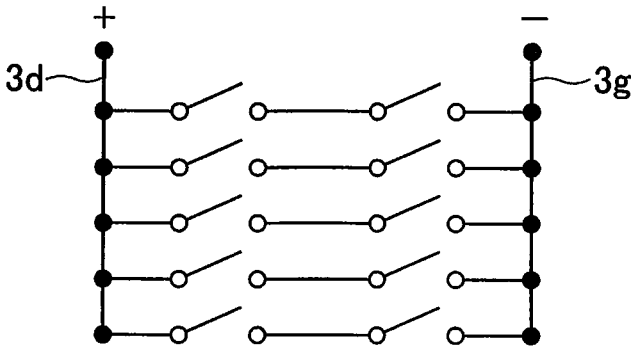
FIG. 21 is an explanatory diagram of electrical wiring in relation to FIG. 20.

FIG. 20 is a cross-sectional view of the pressurized area A shown in FIG. 19, and shows that the positive electrode 3*d* and the negative electrode 3*g* are in a non-conductive state. FIG. 21 shows an electrical wiring state of the pressurized area A.

That is, in the state of FIGS. 20 and 21, the conductor 2*b* of the first base material 2 is separated from the positive electrode 3*d* and the negative electrode 3*g* of the second base material 3 via the spacer 4, and the positive electrode 3*d* and the negative electrode 3*g* are non-conductive because of no-contact between the conductor 2*b* and the second base material 3.

Figure 22:
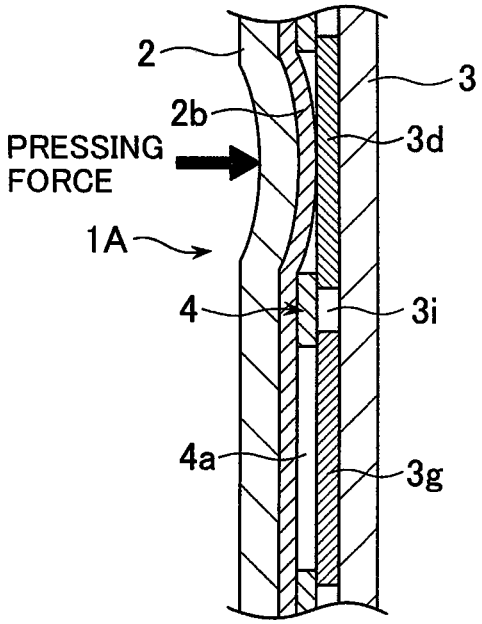
FIG. 22 is an operation explanatory diagram according to the second embodiment of the present invention.
Figure 23:
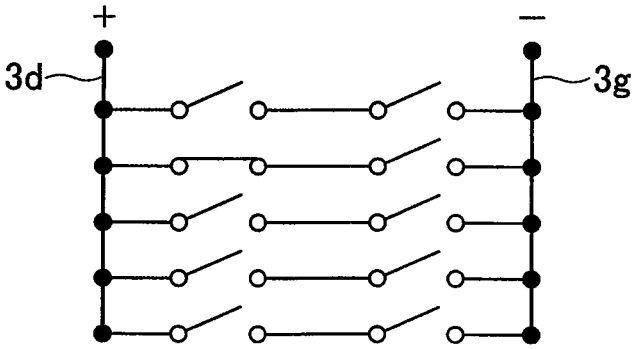
FIG. 23 is an explanatory diagram of electrical wiring in relation to FIG. 22.

In FIG. 22, two portions contact each other within one of the windows 4*a* by finger pressing, while there is no contact within the other window 4*a*. Owing to this, as shown in FIG. 23, the positive electrode 3*d* and the negative electrode 3*g* are non-conductive.

Figure 24:
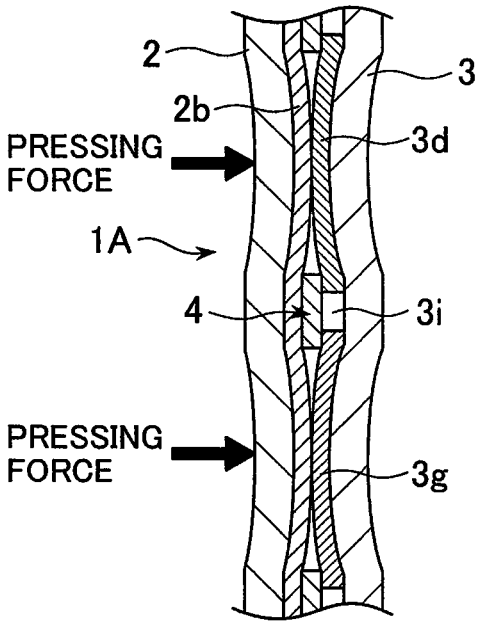
FIG. 24 is an operation explanatory diagram according to the second embodiment of the present invention.
Figure 25:
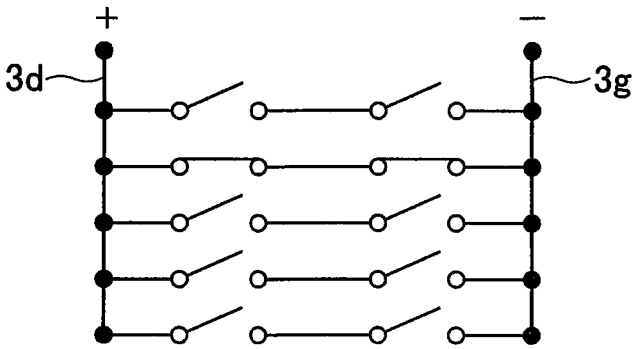
FIG. 25 is an explanatory diagram of electrical wiring in relation to FIG. 24.

In FIG. 24, two portions contact each other within each of the two adjacent windows 4*a* by finger printing, so that the positive electrode 3*d* contacts the negative electrode 3*g* via the conductor 2*b*. Therefore, FIG. 24 shows the conductive state as also shown in FIG. 25.

Figure 26:
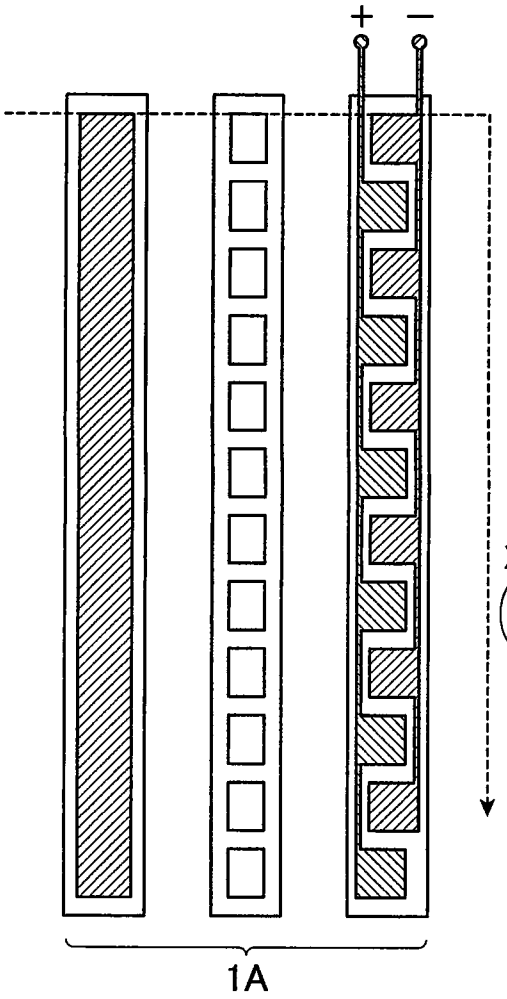
FIG. 26 is an explanatory diagram of on and off states by bending according to the second embodiment of the present invention.
Figure 27:
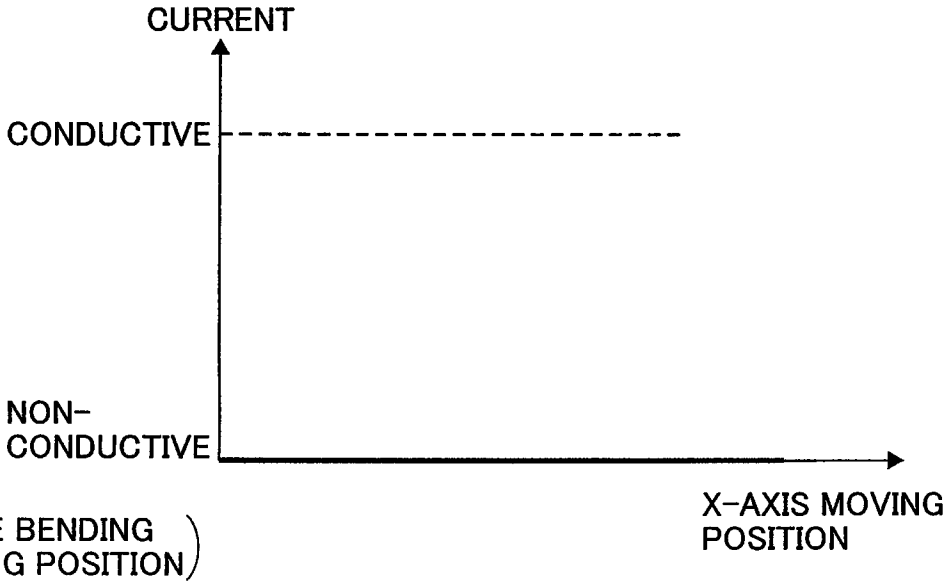
FIG. 27 is an explanatory diagram of on and off states by bending according to the second embodiment of the present invention.

FIG. 26 shows non-conductive and conductive states as also shown in FIG. 27 if the cable switch 1A configured as shown in FIG. 26 according to the second embodiment is bent.

In this embodiment, as indicated by part A in FIG. 19, the positive electrode 3*d* and the negative electrode 3*g* are made to face the adjacent windows 4*a* of the spacer 4, respectively, and a gap 3*h* is provided at a position hidden behind the joint portions 4*c* of the windows 4*a*. Therefore, as shown in FIG. 27, bending does not produce the electrical conduction.

Figure 29:
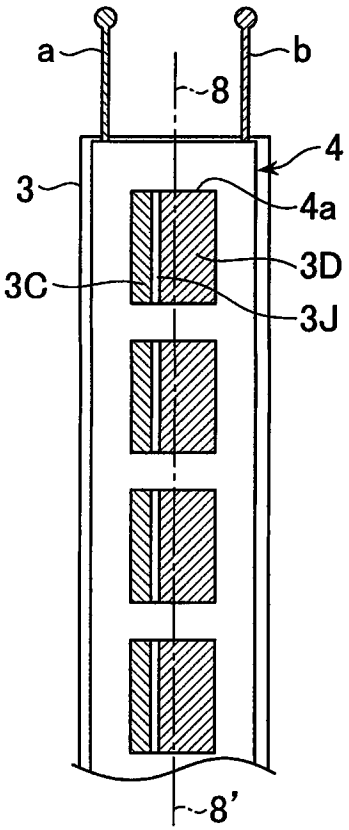
FIG. 29 is a partial plan view in a partially assembled state.
Figure 28:
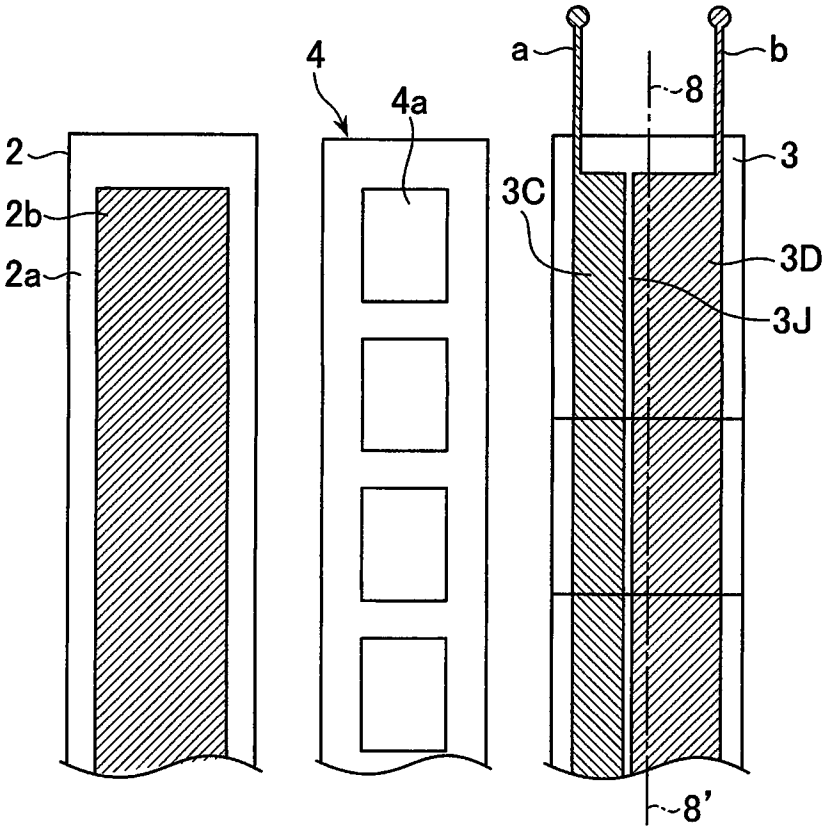
FIG. 28 is a partial plan view of main constituent elements according to a third embodiment of the present invention.

FIG. 28 is a partial plan view of main constituent elements according to a third embodiment of the present invention. FIG. 29 is a partial plan view in a partially assembled state.

This embodiment is characterized as follows. A positive electrode 3C and a negative electrode 3D provided on the inner surface of the second base material 3 are simple in shape, that is, of linear shapes. An insulating gap 3J between the positive electrode 3C and the negative electrode 3D is also of a linear shape.

If the linear constituent elements are used in the second base material 3, it is advantageously possible to facilitate manufacturing as compared with the configuration in which the corrugated or rectangular electrodes are used and alternately arranged to face each other as described in the first and second embodiments.

In this embodiment, a width of the positive electrode 3C is smaller than that of the negative electrode 3D. Therefore, the gap 3J is at an offset position from the central position of the width of the second base material 3 as indicated by a dashed line of reference symbols 8-8'.

That is, if the gap 3J is located in a central portion and the cable switch is bent, then the conductor 2*b* of the first base material 2 easily contacts the positive electrode 3C and the negative electrode 3D, thereby making it easy to produce the electrical conduction between the positive electrode 3C and the negative electrode 3D. In this embodiment, by contrast, since the gap 3J is offset from the central portion, the electrical conduction is not easily produced when the cable switch is bent.

For practical use of the cable switch according to this embodiment, the electrical conduction can be produced between the positive electrode 3C and the negative electrode 3D by pressurizing a portion within one window 4*a* by, for example, a finger. This is because the positive electrode 3C and the negative electrode 3D are located within one window 4*a* in this embodiment, differently from the second embodiment.

In each of the embodiments, as illustrated in the relevant drawings, the positive electrode is arranged on the right side and the negative electrode is arranged on the left side. Needless to say, the positive electrode and the negative electrode may be arranged oppositely. Furthermore, the spacer 4 of the band shape shown in FIG. 16B or 16C may be used in the second or third embodiment.

Figure 30:
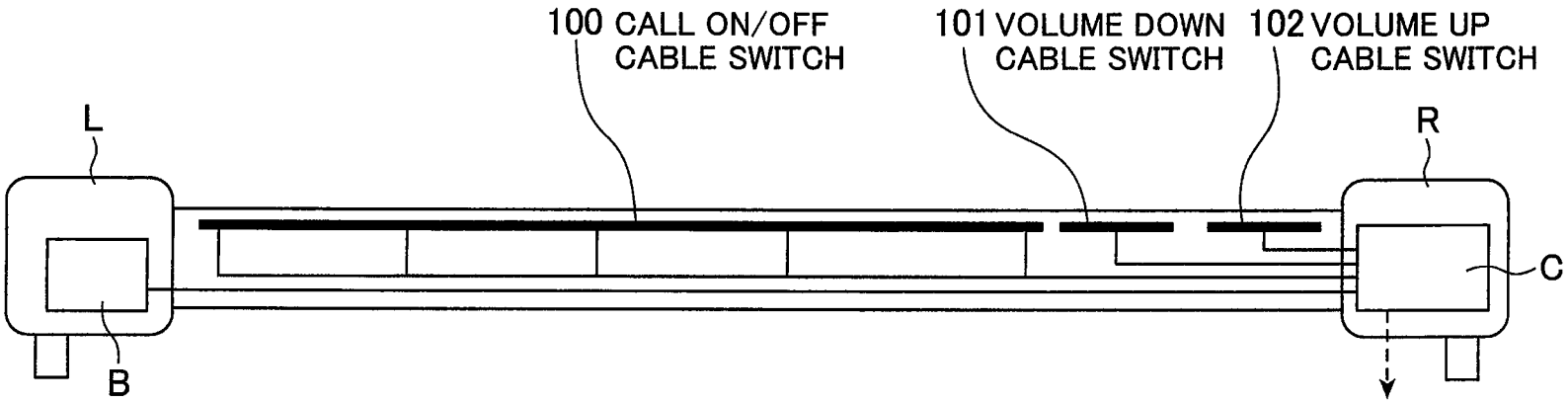
FIG. 30 shows an example to which the present invention is applied.

FIG. 30 is a conceptual diagram of an example in which the cable switch according to the present invention is applied to well-known earphones having a wireless function incorporated therein. That is, FIG. 30 shows a state in which a left earphone L including a battery B therein is connected to a right earphone R including a predetermined circuit C therein by the cable switch.

FIG. 30 shows the example in which a call ON/OFF cable switch 100, a volume down cable switch 101, and a volume up cable switch 102 are incorporated into one flat cable switch.

The battery B is connected to the circuit C and acts as a power supply of the circuit C. The call cable switch 100, the volume down cable switch 101, and the volume up cable switch 102 are each connected to the circuit C, so that the circuit C operates in response to appropriate operation of one of the switches.

The intended use of the cable switch according to the present invention is not limited to that described so far. Since the electrical conduction is difficult to be produced or is not produced when the cable switch is bent, the cable switch according to the present invention is also available as a touch sensor installed on a curved surface.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A cable switch comprising:

a first base member of a band shape provided with a conductor on an inner surface thereof; and a second base member facing the first base member, and including a flat positive electrode and a negative electrode, the positive electrode being provided on one side of an inner surface thereof and the negative electrode being provided on another side of the inner surface, a gap being formed between the positive electrode and the negative electrode for separating and insulating the positive electrode and the negative electrode from each other;

wherein generally rectangular windows arranged at predetermined intervals are formed in a length direction by means of a spacer provided between the positive electrode and the negative electrode, thereby allowing for electrical conduction between the positive electrode and the negative electrode via the conductor; and wherein the positive and negative electrodes are configured such that adjacent conductive points thereof are avoided proximate centers of the generally rectangular windows, such that initiation of the electrical conduction by bending of the cable switch about an axis perpendicular to the length direction is inhibited without preventing initiation of the electrical conduction by finder pressing the first and second base members together.

2. The cable switch according to claim 1, wherein the positive electrode and the negative electrode are corrugated to alternately face each other, and the gap between the positive electrode and the negative electrode is also corrugated.

3. The cable switch according to claim 1, wherein the positive electrode and the negative electrode are rectangular to alternately face each other, and the gap between the positive electrode and the negative electrode is also rectangular.

4. The cable switch according to claim 1, wherein the positive electrode and the negative electrode are linear, the gap between the positive electrode and the negative electrode is also linear, and a position of the linear gap is offset from a central portion of a width of the windows.

* * * * *